United States Patent [19]

Ovens et al.

[11] Patent Number: 4,785,230

[45] Date of Patent: Nov. 15, 1988

[54] TEMPERATURE AND POWER SUPPLY INDEPENDENT VOLTAGE REFERENCE FOR INTEGRATED CIRCUITS

[75] Inventors: Kevin M. Ovens, Garland; John D. Marsh, Dallas, both of Tex.

[73] Assignee: Texas Instruments Incorporated, Dallas, Tex.

[21] Appl. No.: 42,492

[22] Filed: Apr. 24, 1987

[51] Int. Cl.[4] ..... G05F 3/18

[52] U.S. Cl. ..... 323/313; 307/317 A; 307/491

[58] Field of Search ..... 307/49.1, 310, 317 A; 323/313, 314

[56] References Cited

U.S. PATENT DOCUMENTS

| | | | |
|---|---|---|---|
| 3,648,153 | 3/1972 | Graf | 323/313 |
| 3,900,344 | 8/1975 | Magdo | 357/15 |
| 3,968,272 | 7/1976 | Anand | 357/15 |
| 4,107,835 | 8/1978 | Bindell et al. | 357/15 |
| 4,179,533 | 12/1979 | Christou et al. | 357/15 |
| 4,426,655 | 1/1984 | Bhatia et al. | 357/15 |
| 4,542,331 | 9/1985 | Boyer | 323/313 |
| 4,635,230 | 1/1987 | Thomas et al. | 357/15 |
| 4,686,449 | 8/1987 | Jeffrey et al. | 323/313 |

*Primary Examiner*—Patrick R. Salce
*Assistant Examiner*—Jeffrey Sterrett
*Attorney, Agent, or Firm*—Larry C. Schroeder; James T. Comfort; Melvin Sharp

[57] ABSTRACT

A voltage reference circuit which includes a first diode having a first predetermined forward voltage drop as a function of current, a second diode having a second predetermined forward voltage drop as a function of current, lower by a preselected amount than said first diode voltage drop and connected to a voltage reference node and to one end of said first diode. A resistor is connected to the voltage reference node and to another end of the first diode such that the second diode and the resistor form a current path around the first diode. The arrangement is such that the temperature coefficient of voltage at the voltage reference node is less than that across the first diode.

14 Claims, 1 Drawing Sheet

TEMPERATURE AND POWER SUPPLY INDEPENDENT VOLTAGE REFERENCE FOR INTEGRATED CIRCUITS

BACKGROUND OF THE INVENTION

The present invention relates to a voltage reference source which is temperature compensated and which is particularly adapted for use on integrated circuit chips.

A common type of regulated temperature compensated voltage reference source is a forward biased diode in series with a zener diode. The negative temperature coefficient of voltage of the zener diode is partially compensated for by the positive temperature coefficient of voltage of the forward biased diode. However, the range of voltages available are of the order of at least a few volts and the degree of temperature compensation is fixed by the characteristics of each device.

The approach in such areas as emitter coupled logic has been to utilize a single regulated source to serve a large number of different gates. The problem in using a single source for a large number of gates lies in the fact that with the long leads from the source have an appreciable resistance and associated capacitance and, consequently, the voltage at the ends of such lines tends to vary depending on instantaneous current demands. It would be desirable to have a small simple regulated supply that would be small enough to serve only a small number of gates.

Accordingly, it is an object of the invention to provide an improved voltage reference circuit for use on integrated circuit chips. It is a further object of the present invention to provide a voltage reference circuit that is simple and small and has improved temperature compensation.

SUMMARY OF THE INVENTION

According to the present invention there is provided a voltage reference circuit having a first diode with a first predetermined forward voltage drop as a function of current and a second diode having a second predetermined forward voltage drop as a function of current, lower by a preselected amount than said first diode voltage drop and connected to a voltage reference node and to one end of said first diode. A resistive load is connected to the voltage reference node and to another end of the first diode such that the second diode and the resistive load form a current path around the first diode. The diodes are of a type such that the temperature coefficient of voltage at the voltage reference node is less than that across the first diode. Preferably a current source is used in series with the first diode.

Since the temperature coefficient of voltage of each diode is a function of current through that diode it is possible to select a resistive load such that an optimum matching of the temperature coefficients of voltage is achieved at the reference node. In the event that the temperature coefficients overlap it is possible to set the currents in each diode such that exact matching is achieved and the voltage at the reference node has zero temperature coefficient of voltage. If the voltage reference circuit is to be used for emitter coupled logic then advantageously the first diode is a platinum silicide Schottky diode and the second diode is a titanium-tungsten Schottky diode.

Since the voltage reference circuit uses only two diodes, a current source and a resistor, it can be formed in a number of locations over a chip in close proximity to the gates it is to serve and thus provide a very stable voltage source.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
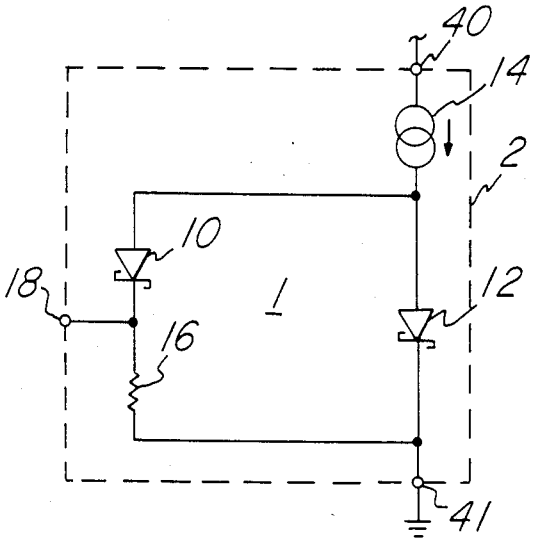
FIG. 1 is a circuit diagram of the voltage reference circuit for an embodiment in which the diode anodes are connected to the current reference source.

Referring to FIG. 1 there is shown one embodiment of the voltage reference circuit 1 formed on a semiconductor substrate 2 having terminals 18, 40, and 41, and which includes a current source 14 connected at one end to a source of high voltage, and a Schottky diode 12 of the platinum silicide type the anode of which is connected to the other end of the current source 14 and the cathode of which is connected to ground. The anode of a second Schottky diode 10, of the titanium tungsten type, is connected to the current source 14 while its cathode is connected to a regulated voltage node 18. A resistor 16 is connected from the regulated node 18 to ground. The particular choice of diodes has been selected to provide a regulated output voltage which is of a magnitude suitable for emitter coupled logic (ECL). In this case the platinum silicide Schottky diode has a forward drop of about 600 millivolts while the titanium tungsten has a forward voltage drop of the order of 300 millivolts. Depending on current the platinum silicide diode exhibits a temperature coefficient of voltage in the range of 0.9 to 1.9 millivolts/°C. while titanium-tungsten has a coefficient in the range of 0.6 to 1.0 millivolts/°C. However, it is possible to select a number of other diode types depending on the voltage desired and the degree of matching required.

In operation if the current source 14 provides sufficient current, diode 12 will be forward biased to its typical operating forward voltage drop which for platinum silicide is of the order of 0.6 volts and diode 10 will also be biased to its typical operating forward voltage drop. For titanium tungsten the forward voltage drop of Schottky diode 10 is of the order of 300 millivolts leaving a voltage drop across resistor 16 of 300 millivolts. Given the temperature coefficient range of diode 12 being 0.9 to 1.9 millivolts/deg C. and that of diode 10 being 0.6 to 1.0 millivolts/deg C., by proper adjustment of the current through each diode it is possible to adjust the temperature coefficient of the voltage at regulator node 18 to be in the range of −0.1 to 1.3 millivolts/deg C. The actual temperature coefficient in each diode will be determined by the current density in that diode and, hence will be a combination of the diode size and the diode current.

As an example of power supply independence, if the current through diode 12 changes by a factor 2, the voltage at the anode of diode 12 changes only about 18 millivolts according to typical diode characteristics. If the current source 14 were a resistor to a 5 volt supply, a 10% change in supply voltage would change the voltage across diode 12 by 3 millivolts if the current through diode 12 and diode 10 were equal. The majority of this change would appear at regulator node 18. For a 300 millivolt output this would correspond to a 1.0% change.

Figure 2:
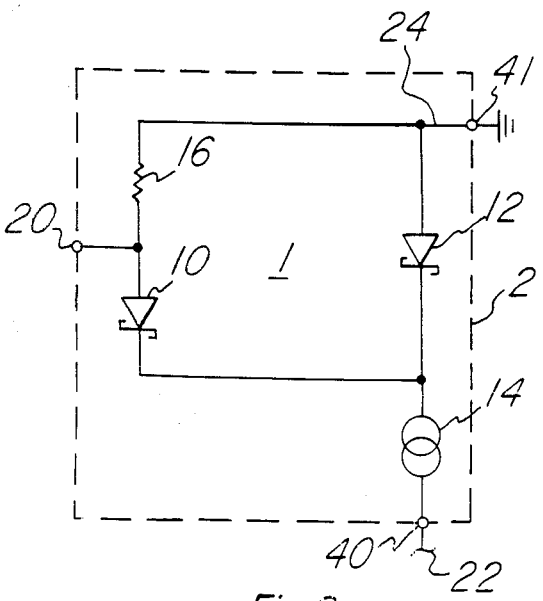
FIG. 2 is a circuit diagram of the voltage reference circuit for an embodiment in which the diode cathodes are connected to the current reference source.

A variant of the circuit of FIG. 1 is shown in FIG. 2 in which like components have like reference numbers. In this case the current source 14 is tied to the cathodes of diodes 10 and 12 and the regulated output node 20 is negative relative to ground node 24. Otherwise, the operation of the circuit of FIG. 2 is identical to that of FIG. 1.

Figure 3:
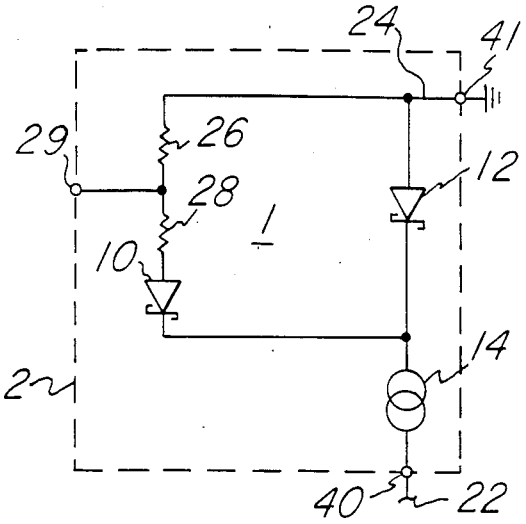
FIG. 3 is a circuit diagram of the voltage reference circuit in which the resistive element in series with one of the diodes is formed by two resistors in series and the reference output is taken from the junction of the two resistors.

Referring to FIG. 3 there is shown a circuit identical to that of FIG. 2 except that a resistor chain consisting of resistors 26 and 28 have been used rather than a single resistor 16, and the reference voltage output 29 has been taken from the junction of the two resistors 26 and 28. This arrangement permits adjustment of the reference voltage to any desired value between 0 and the value at the junction of diode 10 and resistor 28.

Figure 4:
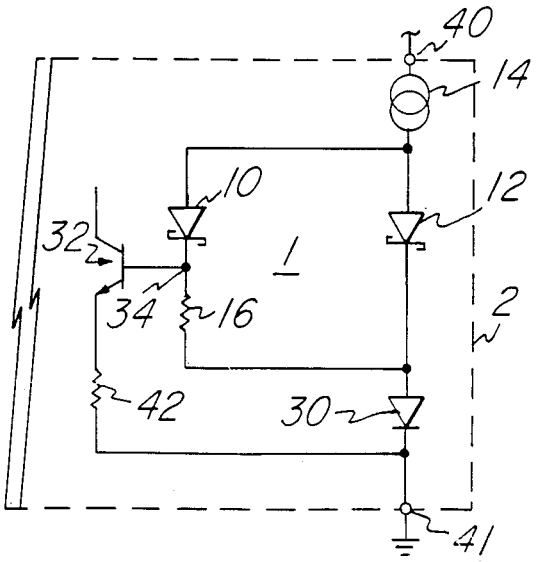
FIG. 4 is a circuit diagram of the voltage reference circuit as used in a typical application.

FIG. 4 shows the circuit of FIG. 1 as coupled to a transistor 32. Transistor forms part of another circuit (not shown). In this case a diode 30 performs a level adjustment and at the same time compensates for the voltage drift of the emitter-base voltage of transistor 32. Although the circuits of FIGS. 1 to 4 exemplify Schottky diodes the compensation technique is applicable to any two diodes which have similar temperature coefficients but different forward voltage drops. The circuits shown are simple in construction and can usefully be placed at various locations of a semiconductor chip to serve up to 5 gates or possibly more and avoid the long leads that must be run with conventional reference supplies that serve a much larger number of gates.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is, therefore, contemplated that the appended claims will cover any such modifications or embodiments as fall within the true scope of the invention.

What is claimed is:

1. A voltage reference circuit, comprising:

a first diode having a first predetermined forward voltage drop as a function of current;

a second diode having a second predetermined forward voltage drop as a function of current, lower by a preselected amount than said first diode voltage drop and connected to a compensated node and to one end of said first diode; and a resistive element connected to said compensated node and to another end of said first diode such that said second diode and said resistive element form a current path around said first diode;

wherein the temperature coefficient of voltage at said compensated node is less than that across said first diode.

2. A circuit according to claim 1, including a current source in series with said first diode.

3. A circuit according to claim 2, wherein said first and second diodes are Schottky diodes of different metal types.

4. A circuit according to claim 3, wherein said first diode is platinum silicide on silicon and said second diode is titanium tungsten on silicon.

5. A circuit according to claim 2, wherein the temperature coefficients of voltage of said first and second diodes overlap.

6. A circuit according to claim 2, wherein said resistive element is a plurality of series connected resistors.

7. A circuit according to claim 1, wherein said resistive element is a resistor.

8. A voltage reference circuit formed on a face of a semiconductor body, comprising:

a first Schottky diode having a first predetermined forward voltage drop as a function of current;

a current source in series with said first diode;

a second Schottky diode having a second predetermined forward voltage drop as a function of current lower by a preselected amount than said first diode voltage drop and connected to a voltage reference node and to one end of said first diode;

resistive means connected to said compensated node and to another end of said first diode such that said second diode and said resistive means form a current path around said first diode; and wherein the difference in the temperature coefficient of voltage of said first and second diodes is less than that of said first diode.

9. A circuit according to claim 8, wherein the anodes of said diodes are both connected to said current source.

10. A circuit according to claim 9, wherein said first diode is platinum silicide on silicon and said second diode is titanium tungsten on silicon.

11. A circuit according to claim 8, wherein the cathodes of said diodes are both connected to said current source.

12. A circuit according to claim 11, wherein said first diode is platinum silicide on silicon and said second diode is titanium tungsten on silicon.

13. A circuit according to claim 8, wherein said resistive means is a resistor.

14. A circuit according to claim 8, wherein said resistive means is a plurality of series connected resistors.

* * * * *